US006609270B2

(12) United States Patent
Kim

(10) Patent No.: US 6,609,270 B2
(45) Date of Patent: Aug. 26, 2003

(54) DISCHARGE GRILL MOUNTING STRUCTURE OF UPRIGHT VACUUM CLEANER

(75) Inventor: Nae-Jung Kim, Kwangju (KR)

(73) Assignee: Samsung Kwangju Electronics Co., Ltd. (KR)

( * ) Notice: Subject to any disclaimer, the term of this patent is extended or adjusted under 35 U.S.C. 154(b) by 0 days.

(21) Appl. No.: 09/760,828

(22) Filed: Jan. 17, 2001

(65) Prior Publication Data

US 2001/0008035 A1 Jul. 19, 2001

Related U.S. Application Data

(63) Continuation-in-part of application No. 09/528,244, filed on Mar. 17, 2000, now abandoned.

(30) Foreign Application Priority Data

Jan. 17, 2000 (KR) ..... 2000-2057
Dec. 29, 2000 (KR) ..... 2000-86383

(51) Int. Cl.[7] ..... A47L 9/12
(52) U.S. Cl. ..... 15/347; 15/351; 55/DIG. 3
(58) Field of Search ..... 15/347, 350, 351, 15/352; 55/372, 493, DIG. 3

(56) References Cited

U.S. PATENT DOCUMENTS 5,685,894 A * 11/1997 Bowerman et al. ..... 15/350
5,762,667 A * 6/1998 Pippel et al. ..... 55/493
5,867,863 A * 2/1999 McCormick ..... 15/347
5,946,771 A * 9/1999 Bosyj et al. ..... 15/347
5,961,676 A * 10/1999 King et al. ..... 15/347
6,085,382 A * 7/2000 Bobrosky et al. ..... 15/350
6,151,751 A * 11/2000 McCormick et al. ..... 15/351

* cited by examiner

*Primary Examiner*—Theresa T. Snider
(74) *Attorney, Agent, or Firm*—Burns, Doane, Swecker & Mathis, L.L.P.

(57) ABSTRACT

An air exhaust structure of an upright-type vacuum cleaner includes a duct vertically formed in a side of a cleaner body, communicating with a motor driving chamber, a supporting member protruded from an inner wall of the duct to a predetermined height, a filter supported by the supporting member and received in the duct, and a grill hinged to the cleaner body for opening and closing an air discharge opening of the duct. The air exhaust structure of the upright-type vacuum cleaner enables simple fabrication and reduced number of parts and fabrication cost.

14 Claims, 5 Drawing Sheets

DISCHARGE GRILL MOUNTING STRUCTURE OF UPRIGHT VACUUM CLEANER

This application is a continuation-in-part of application Ser. No. 09/528,244 filed Mar. 17, 2000 now abandoned, which designates the United States.

BACKGROUND OF THE INVENTION

1. Field of the Invention

The present invention relates to an upright-type vacuum cleaner, and more particularly to an air exhaust structure of the upright-type vacuum cleaner.

2. Description of the Related Art

Generally, an upright-type vacuum cleaner has a suction brush that is movably connected to a cleaner body. The suction brush moves along the cleaning surface during the cleaning process. A dust collecting chamber is defined in an upper portion of the cleaner body, and a motor driving chamber is defined in a lower portion of the cleaner body. A dust filter is detachably disposed in the dust collecting chamber, and a motor is disposed in the motor driving chamber.

When the motor operates, it generates a strong suction force at the suction brush. The suction force draws contaminants with air from the cleaning surface through the suction brush into the cleaner body. The air is then discharged through the dust filter in the dust collecting chamber to the motor driving chamber. The contaminants entrained in the air are collected by the dust filter, and the clean air is discharged into the atmosphere through the motor driving chamber.

The air must be discharged into the atmosphere without contaminants residue in an unobstructed manner. Many designs of air exhaust structures are suggested for an efficient air discharge from the motor driving chamber into the atmosphere.

An example of an air exhaust structure of the upright-type vacuum cleaner is disclosed in the U.S. Pat. No. 5,946,771 (published on Sep. 7, 1999). As shown in FIG. 1, the disclosed air exhaust structure of the upright-type vacuum cleaner has a discharge duct 3 disposed at a side of a cleaner body 1, communicating with a motor driving chamber 2, a plurality of louvers 4 vertically extended at a predetermined space from each other, inside the discharge duct 3, a filter pad 5 externally disposed on the louvers 4, a supporting frame 6 attached to the cleaner body 1 for supporting the filter pad 5, and a grill 7 hinged to the supporting frame 6 for covering the filter pad 5.

The air discharged through the motor driving chamber 2 is distributed through the louvers 4. Air carry velocity increases as the air flows through the louvers 4. Contaminants entrained in the air are filtered through the filter pad 6, and the clean air is discharged through the grill 7 into the atmosphere.

According to the conventional air exhaust structure of the upright-type vacuum cleaner as constructed above, the louvers 4 of complex shape are disposed inside the discharge duct 3, and the supporting frame 6 for supporting the filter pad 5 is additionally fabricated and attached to the cleaner body 1. Accordingly, fabrication process becomes complex and the number of parts and fabrication cost are increased.

SUMMARY OF THE INVENTION

The present invention has been made to overcome the above-mentioned problems of the related art. Accordingly, it is an object of the present invention to provide an improved air exhaust structure of an upright-type vacuum cleaner enabling a simple fabrication process and a decreased number of parts.

The above object is accomplished by an air exhaust structure of an upright-type vacuum cleaner according to the present invention, which includes a duct vertically formed in a side of a cleaner body, communicating a with motor driving chamber, a supporting member protruding from an inner wall of the duct to a predetermined height, a filter supported by the supporting member and received in the duct, and a grill hinged to the cleaner body for opening and closing an air discharging opening of the duct.

The inner wall of the duct is inclined from an air inflow channel formed in a lower portion of the duct, upwardly to the grill at a low angle slope. The supporting member protrudes from a center of the inner wall of the duct to a predetermined height, the supporting member being spaced apart from the grill.

A supporting frame protrudes from an outer circumference of the air discharge opening of the duct for supporting outer edges of the filter. A semi-circular recess is formed at a side of the supporting frame, for enabling easy detachment of the filter.

BRIEF DESCRIPTION OF THE DRAWINGS

The above object and other features and advantages of the present invention will become readily apparent by reference to the following detailed description when considered in conjunction with the accompanying drawings, in which.

DETAILED DESCRIPTION OF THE PREFERRED EMBODIMENT

Hereinafter, the preferred embodiment of the present invention will be described in further detail with reference to the accompanying drawings.

Figure 1:
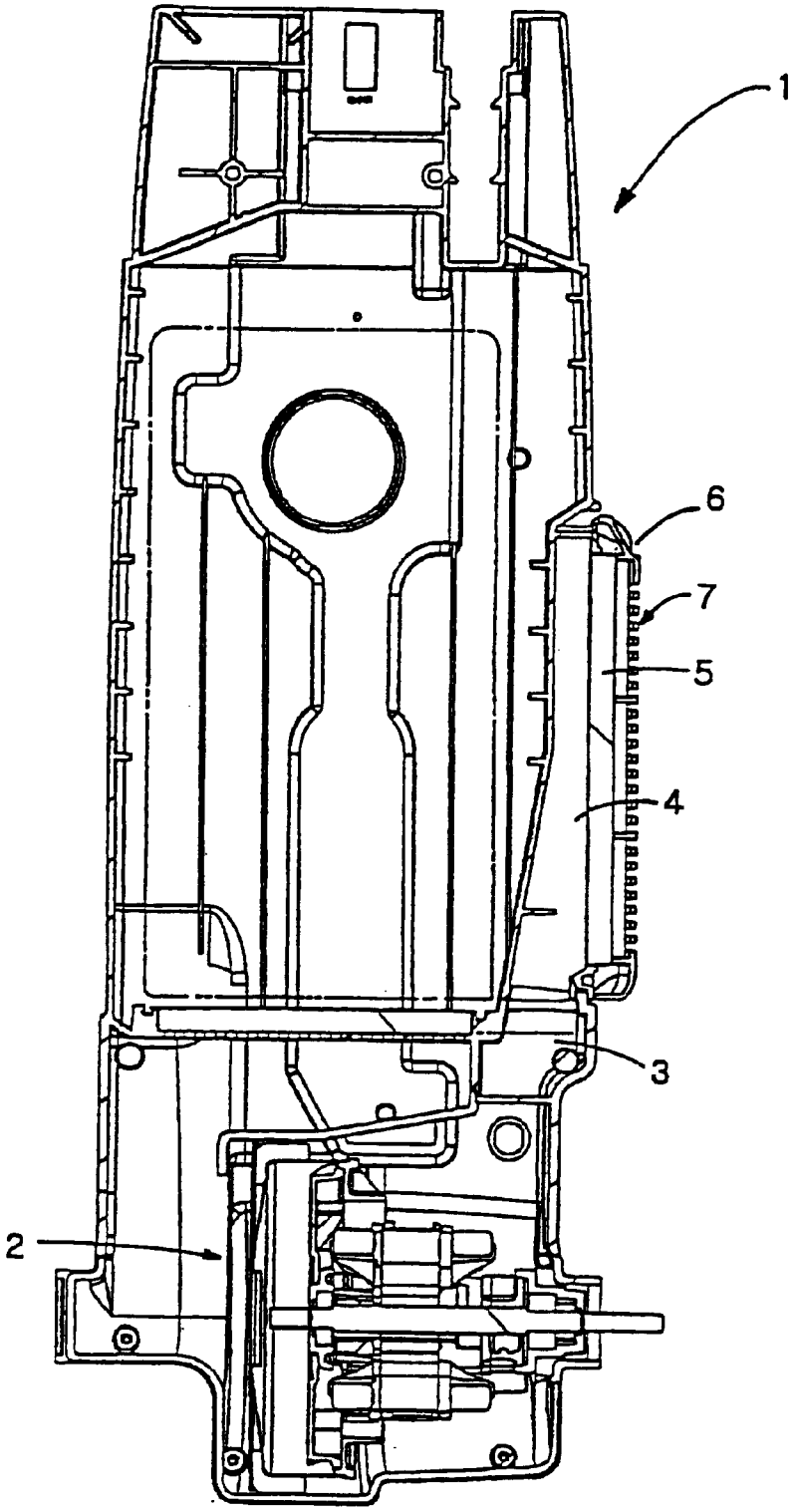
FIG. 1 (PRIOR ART)
FIG. 1 is a cross sectional elevation view showing a cleaner body of a conventional upright-type vacuum cleaner.
Figure 2:
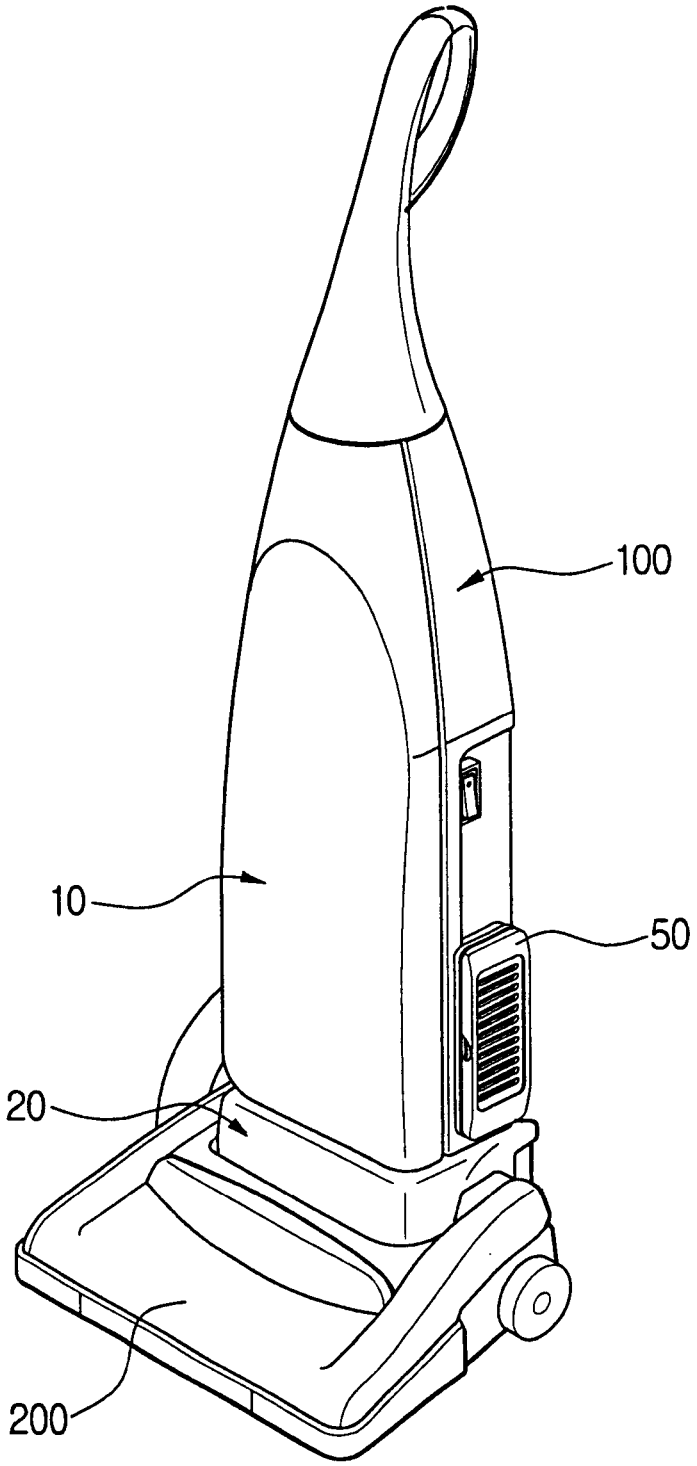
FIG. 2 is a schematic perspective view showing an upright-type vacuum cleaner according to the present invention.

As shown in FIG. 2, an upright-type vacuum cleaner according to the present invention includes a suction brush 200 movably connected to a lower portion of a cleaner body 100, which moves along the cleaning surface during the cleaning process. The cleaner body 100 has a dust collecting chamber 10 and a motor driving chamber 20. A dust filter (not shown) is detachably disposed in the dust collecting chamber 10, and a motor (not shown) is disposed in the motor driving chamber 20. A grill 50 is hinged to a side of the cleaner body 100.

Figure 3:
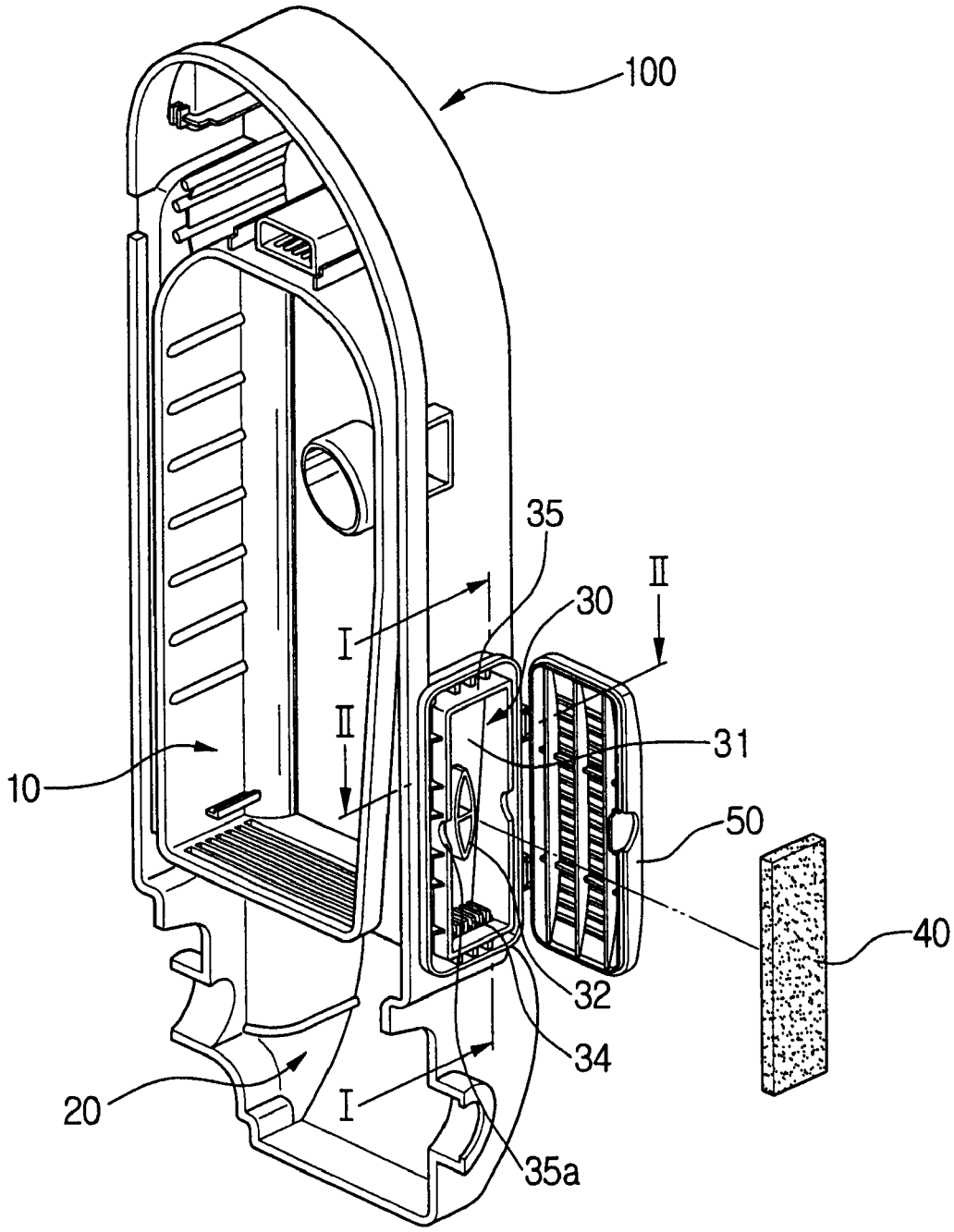
FIG. 3 is a schematic perspective view showing a cleaner body of FIG. 2.

As shown in FIG. 3, an air exhaust structure of the upright-type vacuum cleaner according to the present invention includes a duct 30 vertically formed on a side of the cleaner body 100, communicating with the motor driving chamber 20, a supporting member 32 protrudes from an inner wall 31 of the duct 30, to a predetermined height, a filter 40 received in the duct 30, and a grill 50 hinged to the cleaner body 100 for opening/closing an air discharge opening 30*a* (FIG. 4) of the duct 30.

Figure 4:
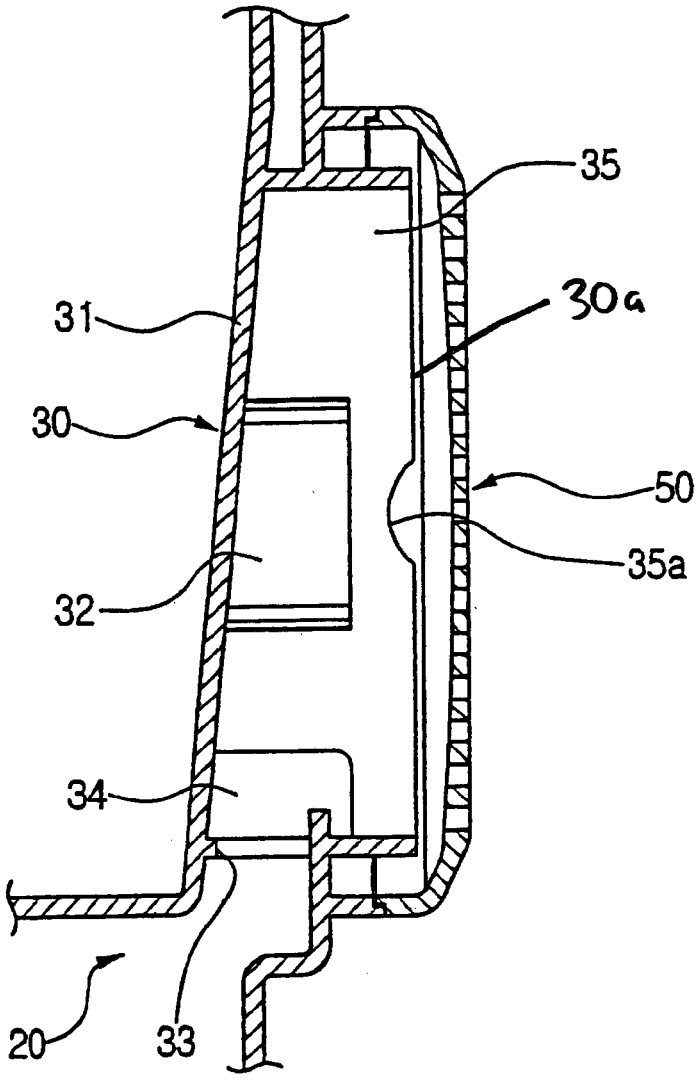
FIG. 4 is a cross sectional elevation view taken on line I—I of FIG. 3.

As shown in FIG. 4, the duct 30 communicates with the motor driving chamber 20 through an air inflow channel 33. A plurality of cross-plates 34 are disposed across the air inflow channel 33. Air is discharged through the motor driving chamber 20, and distributed by the cross-plates 34 while being drawn into the duct 30 through the air inflow channel 33. The inner wall 31 of the duct 30 is inclined to the grill 50 at a low angle slope. Accordingly, since a cross sectional flow area of the duct 30 is decreased, air carry velocity increases as the air drawn into the duct 30 flows upward as illustrated in the FIG. 4.

The supporting member 32 is protrudes from a center of the inner wall 31 of the duct 30, for supporting the filter 40. The supporting member 32 is spaced apart from the grill 50 at a predetermined distance. It is preferable that the supporting member 32 has a streamlined shape enabling ambient air to flow unobstructed.

A supporting frame 35 protrudes from a side wall of the duct 30 to an outer circumference of the air discharge opening of the duct 30, for supporting outer edges of the filter 40.

Figure 5:
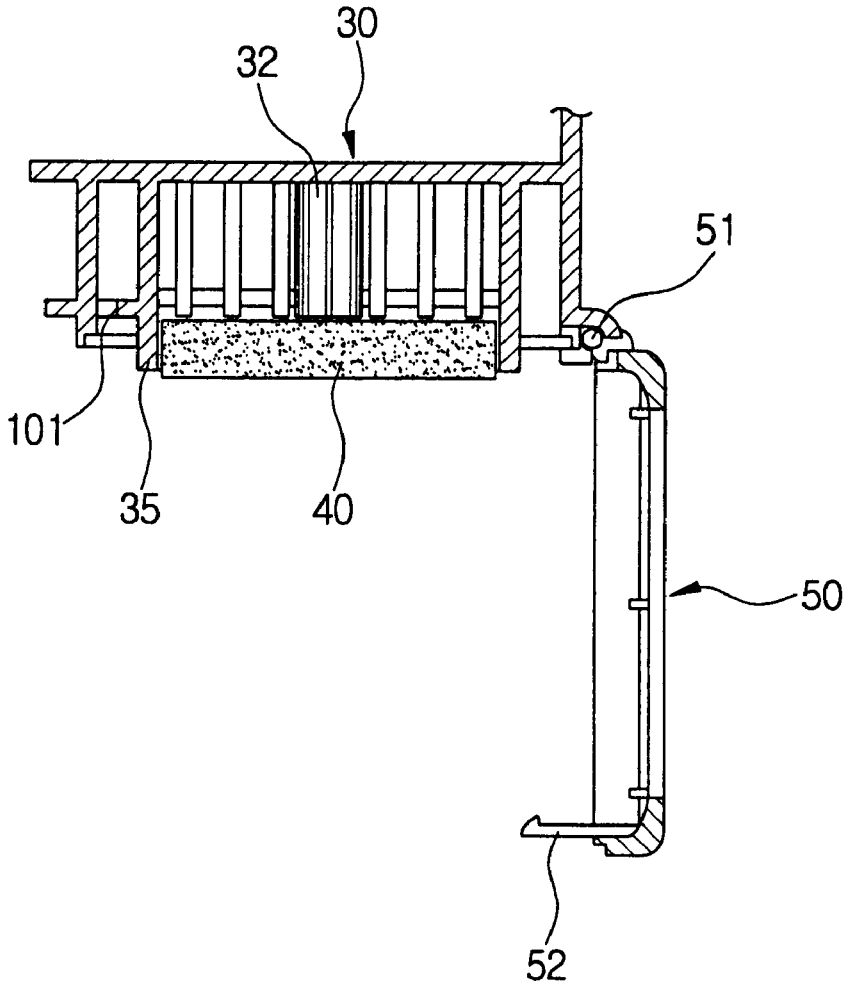
FIG. 5 is a cross sectional horizontal view taken on line II—II of FIG. 3.

As shown in FIG. 5, since a surface of the filter 40 is supported by the supporting member 32 forming an air flow therebetween while the outer edges of the filter 40 are supported by the supporting frame 35, the filter 40 can be received in the duct 30 enabling unobstructed air flow. It is preferable that a thickness of the filter 40 be larger than a distance between an end portion of the supporting member 32 in contact with the filter 40, and an inner wall of the grill 50, so that the filter 40 can be received in a compressed manner between the supporting member 32 and the grill 50 when the grill 50 is closed.

Semi-circular recesses 35*a* are formed at both sides of the supporting frame 35 (refer to FIG. 4). Since the outer blocks of the filter 40 are partially exposed through the semi-circular recesses 35*a*, the filter 40 can be easily detached from the duct 30 when a user replaces or cleans the filter 40.

One side of the grill 50 is hinged to the cleaner body 100 proximate to the supporting frame 35, and hinges on a hinge 51 for opening/closing the air discharge opening of the duct 30. A hook 52 is disposed on the other side of the grill 50 to be selectively inserted in a joint recess 101 of the cleaner body 100.

Air exhausting in the air exhaust structure of the upright-type vacuum cleaner according to the present invention will be described below.

First, air is drawn into the dust collecting chamber 10 together with contaminants through the suction brush 200, then initially filtered through a dust filter (not shown) disposed in the dust collecting chamber 10. Next, the air is drawn into the motor driving chamber 20 and discharged to the duct 30 through the air inflow channel 33. Here, the air is distributed by the plurality of cross-plates 34 disposed across the air inflow channel 33, while being drawn into the duct 30. Then the air is finally filtered through the filter 40. The clean air is discharged into the atmosphere through the grill 50.

The air drawn through the air inflow channel 33 flows faster as upwardly flowing along the inner wall 31 of the duct 30. Accordingly, the air drawn into the duct 30 can be discharged into the atmosphere through the filter 40 and the grill 50 in an unobstructed manner, and less subjected to the distance from the air inflow channel 33.

As described above, the air exhaust structure of the upright-type vacuum cleaner according to the present invention includes the supporting member 32 disposed in the inner wall 31 of the duct 30 for supporting the surface of the filter 40, and the supporting frame 35 integrally formed with the cleaner body 100 for supporting the outer edges of the filter 40, so that simple fabrication and reduced number of parts and fabrication cost can be accomplished.

Although the preferred embodiment of the present invention has been shown and described, it will be appreciated by those skilled in the art that changes may be made in this embodiment without departing from the principles and spirit of the invention, the scope of which is defined in the claims.

What is claimed is:

1. An air exhaust structure of an upright-type vacuum cleaner, comprising:

a duct vertically formed in a side of a cleaner body, wherein said duct is at least partially defined on three sides by an inner wall and two sidewalls at vertical edges of the inner wall, and wherein said duct communicates with a motor driving chamber;

a supporting member protruding from the inner wall of the duct to a predetermined height;

a filter received in an air discharge opening of the duct; and a grill hinged to the cleaner body for opening and closing the air discharge opening of the duct, wherein said filter is supported between said grill and said supporting member, which is opposite to said grill.

2. The air exhaust structure as claimed in claim 1, wherein the inner wall of the duct is inclined from an air inflow channel formed in a lower portion of the duct, upwardly to the grill at a slope.

3. The air exhaust structure as claimed in claim 1, wherein the supporting member protrudes from a center of the inner wall of the duct to said predetermined height, the supporting member being spaced apart from the grill.

4. The air exhaust structure as claimed in claim 1, further comprising a supporting frame protruding from an outer circumference of the air discharge opening of the duct for supporting outer edges of the filter.

5. The air exhaust structure as claimed in claim 4, wherein the supporting frame further comprises a semi-circular recess formed at a side of the supporting frame, for enabling easy detachment of the filter.

6. The air exhaust structure as claimed in claim 1, wherein the duct directly communicates with the motor driving chamber.

7. An air exhaust structure of an upright-type vacuum cleaner, comprising:

a duct vertically formed in a side of a cleaner body, communicating with a motor driving chamber;

a supporting member protruding from an inner wall of the duct to a predetermined height and having a streamlined shape relative to airflow through the duct;

a filter received in an air discharge opening of the duct; and a grill hinged to the cleaner body for opening and closing the air discharge opening of the duct, wherein said filter is supported between said grill and said supporting member, which is opposite to said grill.

8. The air exhaust structure as claimed in claim 7, wherein the inner wall of the duct is inclined from an air inflow channel formed in a lower portion of the duct, upwardly to the grill at a slope.

9. The air exhaust structure as claimed in claim 7, wherein the supporting member protrudes from a center of the inner wall of the duct to said predetermined height, the supporting member being spaced apart from the grill.

10. The air exhaust structure as claimed in claim 7, further comprising a supporting frame protruding from an outer circumference of the air discharge opening of the duct for supporting outer edges of the filter.

11. An air exhaust structure of an upright-type vacuum cleaner, comprising:

a duct vertically formed in a side of a cleaner body, communicating with a motor driving chamber;

a supporting member protruding from an inner wall of the duct to a predetermined height and through which air passing through the duct does not flow;

a filter received in an air discharge opening of the duct; and a grill hinged to the cleaner body for opening and closing the air discharge opening of the duct, wherein said filter is supported between said grill and said supporting member, which is opposite to said grill.

12. The air exhaust structure as claimed in claim 11, wherein the inner wall of the duct is inclined from an air inflow channel formed in a lower portion of the duct, upwardly to the grill at a slope.

13. The air exhaust structure as claimed in claim 11, wherein the supporting member protrudes from a center of the inner wall of the duct to said predetermined height, the supporting member being spaced apart from the grill.

14. The air exhaust structure as claimed in claim 11, further comprising a supporting frame protruding from an outer circumference of the air discharge opening of the duct for supporting outer edges of the filter.

* * * * *